US008036546B2

(12) United States Patent
Misumi et al.

(10) Patent No.: US 8,036,546 B2
(45) Date of Patent: Oct. 11, 2011

(54) ABNORMAL SOUND DIAGNOSTIC APPARATUS, ABNORMAL SOUND DIAGNOSTIC METHOD, RECORDING MEDIUM STORING ABNORMAL SOUND DIAGNOSTIC PROGRAM AND DATA SIGNAL

(75) Inventors: Hajime Misumi, Saitama (JP); Kenji Obuchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 453 days.

(21) Appl. No.: 12/108,883

(22) Filed: Apr. 24, 2008

(65) Prior Publication Data

US 2009/0097870 A1 Apr. 16, 2009

(30) Foreign Application Priority Data

Oct. 15, 2007 (JP) ..... 2007-267851

(51) Int. Cl.
*G03G 15/00* (2006.01)

(52) U.S. Cl. ..... 399/36

(58) Field of Classification Search ..... 399/36, 399/31

See application file for complete search history.

(56) References Cited

U.S. PATENT DOCUMENTS

| | | | | |
|---|---|---|---|---|
| 4,812,876 | A * | 3/1989 | Nawata | 399/11 |
| 2007/0070456 | A1 * | 3/2007 | Nishimura | 358/504 |
| 2007/0122166 | A1 * | 5/2007 | Takahashi et al. | 399/24 |

FOREIGN PATENT DOCUMENTS

| | | |
|---|---|---|
| JP | A-55-90963 | 7/1980 |
| JP | A-62-35916 | 2/1987 |
| JP | A-5-323751 | 12/1993 |
| JP | A-2000-81813 | 3/2000 |
| JP | A 2004-226482 | 8/2004 |
| JP | A-2006-208074 | 8/2006 |
| JP | A-2006-326844 | 12/2006 |
| JP | A-2007-106520 | 4/2007 |
| JP | A-2007-114272 | 5/2007 |
| JP | A-2007-178546 | 7/2007 |

OTHER PUBLICATIONS

Machine translation of Takayama (JP 2007-114,272), Pub date May 10, 2007, translation provided by Applicant.*

Machine translation of Mizuno et al. (JP 2004-226,482), Pub date Aug. 12, 2004, translation provided by Applicant.*

Machine translation of Masunaga et al. (JP 2006-208,074), Pub date Aug. 10, 2006, translation provided by Applicant.*

Japanese Office Action for Application No. 2007-267851, issued Dec. 15, 2009.

* cited by examiner

*Primary Examiner* — David Gray
*Assistant Examiner* — Rodney Bonnette
(74) *Attorney, Agent, or Firm* — Oliff & Berridge, PLC

(57) ABSTRACT

An abnormal sound diagnostic apparatus for an image formation device, which includes: a specification section that specifies an independently operable drive section; an operation section that selectively operates the drive section specified by the specification section; a receiving section that receives an abnormal sound confirmation input which is inputted in a case where an abnormal sound occurs by operating the drive section through the operation section; and an identifying section that, on the basis of the abnormal sound confirmation input received by the receiving section, identifies the drive section specified by the specification section as an abnormal sound occurring location.

7 Claims, 7 Drawing Sheets

710: DIAGNOSIS PROCEDURE INFORMATION

| OPERATION ORDER | | DIAGNOSIS ITEM | DETAILS OF OPERATION |
|---|---|---|---|
| 01 | | DIAGNOSIS FOR ROTARY DEVELOPMENT DEVICE | DRIVE MOTOR OF ROTARY DEVELOPMENT DEVICE, CHECK ABNORMAL SOUND, STOP MOTOR |
| 02 | | DIAGNOSIS FOR FUSER | TURN ON LIGHT AND DRIVE MOTOR OF FUSER, CHECK ABNORMAL SOUND, TURN OFF LIGHT, STOP MOTOR |
| 03 | | DIAGNOSIS FOR PAPER FEEDING SECTION | OPERATE MOTOR, CLUTCH AND OTHER ALL UNITS IN FEEDING SECTION, CHECK ABNORMAL SOUND, STOP ALL THE OPERATED UNITS |
| WHEN ABNORMAL SOUND OCCURS AT 03 | 03-1 | DIAGNOSIS FOR FEED ROLL | OPERATE ONLY MOTORS OF FEED ROLL AND RETARD ROLL, CHECK ABNORMAL SOUND |
| | 03-2 | DIAGNOSIS FOR RESIST ROLL | OPERATE CLUTCH OF RESIST ROLL, CHECK ABNORMAL SOUND, STOP CLUTCH OPERATION |
| | 03-3 | DIAGNOSIS FOR PRE-RESIST ROLL | OPERATE CLUTCH OF PRE-RESIST ROLL, CHECK ABNORMAL SOUND, STOP CLUTCH OPERATION |
| 04 | | DIAGNOSIS FOR IMAGE GENERATION SECTION | DRIVE ALL MOTORS AND CLUTCHES OF IMAGE CARRIER, ROTARY DEVELOPMENT DEVICE, SECONDARY TRANSFER ROLL, BRUSH ROLL AND OTHER UNITS IN IMAGE GENERATION SECTION, OUTPUT HIGH VOLTAGE FROM HIGH VOLTAGE POWER SUPPLY, CHECK ABNORMAL SOUND, STOP ALL UNITS |
| WHEN ABNORMAL SOUND OCCURS AT 04 | 04-1 | DIAGNOSIS FOR IMAGE GENERATION DRIVE SECTION | OPERATE MOTOR AND CLUTCH OF IMAGE CARRIER, AND DEVELOPMENT ROLL, OUTPUT HIGH VOLTAGE FROM HIGH VOLTAGE POWER SUPPLY, CHECK ABNORMAL SOUND |
| | 04-2 | DIAGNOSIS FOR CLEANER FOR INTERMEDIATE TRANSFER UNIT | OPERATE SOLENOID OF BRUSH ROLL, CHECK ABNORMAL SOUND |
| | 04-3 | DIAGNOSIS FOR SECONDARY TRANSFER SECTION | OPERATE SOLENOID OF SECONDARY TRANSFER ROLL, CHECK ABNORMAL SOUND |
| 05 | | COMPREHENSIVE DIAGNOSIS FOR IMAGE FORMATIONS SECTION | OPERATE ALL UNITS IN IMAGE FORMATION SECTION, FEED PAPER SHEET, CHECK ABNORMAL SOUND, STOP ALL UNITS IN IMAGE FORMATION SECTION |

FIG.4

ABNORMAL SOUND DIAGNOSTIC APPARATUS, ABNORMAL SOUND DIAGNOSTIC METHOD, RECORDING MEDIUM STORING ABNORMAL SOUND DIAGNOSTIC PROGRAM AND DATA SIGNAL

CROSS-REFERENCE TO RELATED APPLICATION

This application is based on and claims priority under 35 USC 119 from Japanese Patent Application No. 2007-267851 filed on Oct. 15, 2007.

BACKGROUND

1. Technical Field

The present invention relates to an abnormal sound diagnostic apparatus, an abnormal sound diagnostic method, a recording medium storing an abnormal sound diagnostic program and a data signal.

2. Related Art

With apparatuses including a drive mechanism, such as a motor, there may occur an abnormal sound due to such cause as degradation of a part in the drive mechanism.

For example, an image formation device, such as a multifunctional device, includes a laser unit that emits laser light corresponding to the image to form an image on a paper sheet for outputting; a photosensitive drum that is exposed to the laser light to form a latent image; a developing apparatus that supplies toner onto the photosensitive drum to form a toner image; a paper pick-up section that supplies a paper sheet; a transfer section that transfers the toner image formed on the photosensitive drum onto the paper sheet transported from the paper pick-up section; a fixing section that fixes the toner image transferred on the paper sheet, and the like. These parts and apparatuses are rotated by the driving apparatuses and the power transmission mechanisms, such as the motor, making operations, such as transportation of the paper sheet, transfer and fixing of toner image, and the like, while being contacted with one another.

With the image formation device thus configured, an abnormal sound may occur due to excessive contact, occurrence of a rotational vibration or the like, resulting from wear or degradation of parts or the like The occurrence of the abnormal sound is an indication that the apparatus has something wrong, and gives an uncomfortable feeling to persons around the apparatus.

SUMMARY

An aspect of the present invention provides an abnormal sound diagnostic apparatus for an image formation device, which includes: a specification section that specifies an independently operable drive section; an operation section that selectively operates the drive section specified by the specification section; a receiving section that receives an abnormal sound confirmation input which is inputted in a case where an abnormal sound occurs by operating the drive section through the operation section; and an identifying section that, on the basis of the abnormal sound confirmation input received by the receiving section, identifies the drive section specified by the specification section as an abnormal sound occurring location.

BRIEF DESCRIPTION OF THE DRAWINGS

An exemplary embodiment of the present invention will be described in detail based on the following figures, wherein:

FIG. 4 is a chart schematically illustrating one example of diagnosis procedure information;

DETAILED DESCRIPTION

Hereinbelow, one exemplary embodiment of an abnormal sound diagnostic apparatus, an abnormal sound diagnostic method, a recording medium storing an abnormal sound diagnostic program and a data signal pertaining to the present invention will be described in detail with reference to the accompanying drawings.

Figure 1:
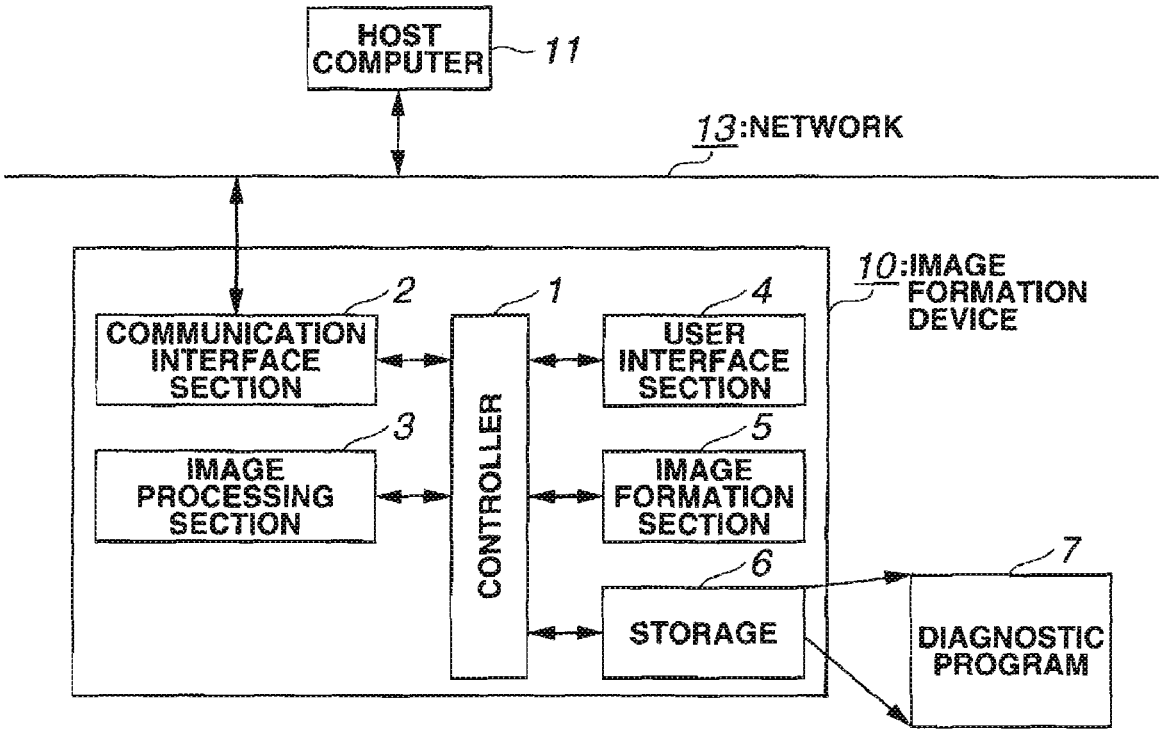
FIG. 1 is a block diagram illustrating an example of a schematic configuration of critical portions of an image formation device 1 pertaining to the present invention.

FIG. 1 is a block diagram illustrating one example of schematic configuration of the critical portions of the abnormal sound diagnostic apparatus for image formation device pertaining to the present invention.

As shown in FIG. 1, an image formation device 10 is connected to a host computer 11 through a network 13, such as an LAN (Local Area Network) or the like, and is configured such that it receives printing data that the host computer 11 requests the image formation device 10 to print, and, in accordance with the printing conditions under which printing the printing data is requested, forms that printing data on a paper sheet included in the image formation device 10 for output.

It should be noted that it may be possible to employ a configuration in which the image formation device 10 is directly connected to the host computer 11 without the network 13.

The host computer 11 is a general-purpose computer that includes an input apparatus (including a keyboard, mouse or the like), an output apparatus (including a display or the like), a central processing apparatus (such as a CPU), a storage (including an ROM, an RAM, a hard disk, an external storage or the like), and the like.

The image formation device 10 includes a controller 1, a communication interface section (hereafter, to be called a "communication I/F section") 2, an image processing section 3, a user interface section (hereafter, to be called a "user I/F section") 4, an image formation section 5, a storage 6, and the controller 1 is a CPU which controls the respective sections constituting the image formation device 10 for supervisingly control the entire image formation device 10.

The communication I/F section 2 carries out communication control for transmitting and receiving a control signal and a data signal through the network 12 under the control of the controller 1.

The image processing section 3 analyzes the printing data that the host computer 11 or the like requests printing of and is stored in an image memory (not shown) of the storage 6, under the control of the controller 1, and generates image data that is formable on a paper sheet.

The user I/F section 4 is provided with an operation button or a display including a touch panel or an LCD (Liquid Crystal Display), and carries out, under the control of the controller 1, interface control between the user and the image formation device 10, such control as inputting instruction information to the image formation device 10 through the operation of the user and displaying status information about the image formation device 10 and various other types of information from the image formation device 10 to the user.

The image formation section 5 includes various motors and sensors, an exposure apparatus including a laser light emitting apparatus, a photosensitive medium, a developing apparatus, a paper transportation mechanism and other various components and apparatuses required for printing operation that forms and outputs the image data on the paper sheet. The image formation section 5 carries out operation control of these various apparatuses under the control of the controller 1.

The configuration of the image formation section 5 will be later described in detail (see FIG. 2).

The storage 6 is made up of a storage, including an ROM (Read Only Memory), an RAM (Random Access Memory) or a hard disk, and carries out, under the control of the controller 1, control of writing data into each of these memory devices, reading-out data from each of these and the like.

In addition, in the storage 6, a later described diagnostic program 7 (see FIG. 3) for carrying out trouble diagnosis and so on for the image formation device 10 is previously installed. With this diagnostic program 7 being executed, the controller 1 of the image formation device 10 carries out control operation, functioning as the abnormal sound diagnostic apparatus pertaining to the present invention, and starts an abnormal sound diagnosis for identifying the cause for occurrence of the abnormal sound in the image formation device 10.

A CPU is an acronym of Central Processing Unit; the ROM is that of Read Only Memory; and the RAM is that of Random Access Memory.

Figure 2:
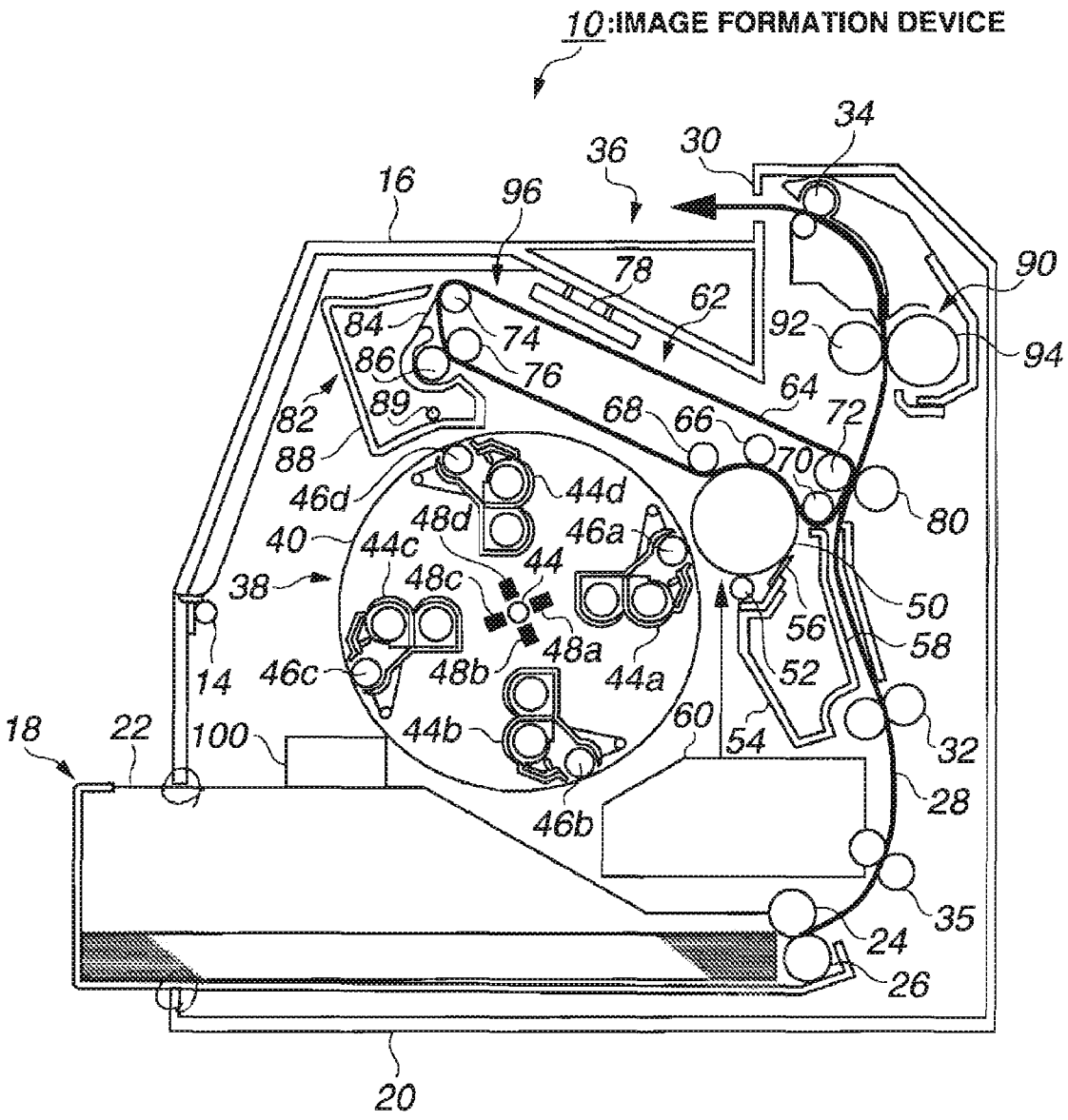
FIG. 2 is a drawing illustrating an example of a detailed configuration of an image formation section 5.

FIG. 2 is a drawing illustrating one example of a detailed configuration of the image formation section 5.

In FIG. 2, the present exemplary embodiment gives an example of a configuration of the image formation section 5 for full color printing, employing an intermediate transfer unit, such as an intermediate transfer belt. However, the configuration is not limited to this. It may be possible to employ a configuration, for example, in which an image is directly transferred from one image carrier to a paper sheet without using an intermediate transfer unit.

As shown in FIG. 2, in the upper portion of the image formation device 10, an open/close cover 16 that is freely rotatable around a pivot 14 is provided. In the lower portion, a paper supply unit 18 is disposed.

The paper supply unit 18 has a paper supply unit main body 20 and a paper supply cassette 22 for containing papers.

In a portion near above the rear end of the paper supply cassette 22, a feed roller 24 for picking up papers from the paper supply cassette 22, and a retard roller 26 for jogging the picked-up paper sheets one by one are disposed.

The feeding path 28 provides a paper passageway from the feed roller 24 to the delivery opening 30. This feeding path 28 is formed substantially vertically from the paper supply unit 18 to the fusing device 90.

On the upstream side of the fusing device 90 in this feeding path 28, a secondary transfer roller 80 and a secondary transfer backup roller 72 are disposed; on the upstream side of the secondary transfer roller 80 and the secondary transfer backup roller 72, a resist roller 32 is disposed; and in the vicinity of the delivery opening 30 in the feeding path 28, a delivery roller 34 is disposed.

Therefore, paper sheets picked up from the paper supply cassette 22 in the paper supply unit 18 by the feed roller 24 are delivered by the retard roller 26. Only the top paper sheet is guided to the feeding path 28, being once stopped by the resist roller 32. After a certain period of time, the paper sheets are passed between the secondary transfer roller 80 and the secondary transfer backup roller 72 to have developer images transferred. Then, these transferred developer images are fixed by the fusing device 90. The paper sheets are delivered from the delivery opening 30 to the delivery section 36 provided above the open/close cover 16 by the delivery roller 34.

The mechanism that thus transports a paper sheet along the feeding path 28 is referred to as the paper feed section for convenience of explanation. This paper feed section includes a drive section constituted by the feed roller 24, the retard roller 26, the preresist roller 35, the resist roller 32, the delivery roller 34 and the like.

in a substantially central portion of the image formation device 10, a rotary development device 38 is disposed. This rotary development device 38 has development devices 44*a* to 44*d* that form developer images of four colors, i.e., yellow, magenta, cyan and black, respectively, inside a developing apparatus main body 40. The rotary development device 38 is rotated in a counterclockwise direction around the rotary development device center 44 in FIG. 2.

The development devices 44*a* to 44*d* have respective developing rollers 46*a* to 46*d*, and are pressed against the developing apparatus main body 40 in the direction normal thereto by elastic bodies 48*a* to 48*d*, such as a coil spring or the like.

The rotary development device 38 is disposed such that an image carrier 50 made up of, for example, a photosensitive medium is butted thereagainst. A part of the periphery of the respective developing rollers 46*a* to 46*d* is projected in the radial direction from the periphery of the developing apparatus main body 40 by, for example, 2 mm when it is not butted against the image carrier 50.

In addition, at both ends of the respective developing rollers 46*a* to 46*d*, tracking rollers (not shown) having a diameter slightly larger than the developing roller 46*a* to 46*d* are provided such that they are rotated coaxially with the developing roller 46*a* to 46*d*. In other words, the tracking rollers for the developing roller 46*a* to 46*d* are butted against flanges (not shown) provided at both ends of the image carrier 50, resulting in a prescribed clearance being formed between the developing roller 46*a* to 46*d* and the image carrier 50, and the latent image on the image carrier 50 is developed by the developer of the respective colors.

Under the image carrier 50, a charging unit 52 made up of a charging roller that uniformly charges the image carrier 50 is provided, and a cleaner 54 for the image carrier is butted against the image carrier 50 on the upstream side of the charging unit 52 in the direction of rotation of the image carrier 50.

The cleaner 54 for the image carrier is formed with a cleaning blade 56 that scrapes the developer being left on the image carrier 50 after the primary transfer, and a developer recovery bottle 58 that collects the developer scraped by the cleaning blade 56.

The back side surface of the developer recovery bottle 58 (at right in FIG. 2) is formed to have, for example, a rib which, as a part of the feeding path 28, is curved such that the paper is smoothly transported. Under the rotary development device 38, an exposure apparatus 60 that uses a beam of laser light or the like to write in a latent image on the image carrier 50 that is charged by the charging unit 52 is disposed.

In addition, above the rotary development device 38, an intermediate transfer apparatus 62 to which a developer image visualized by the rotary development device 38 is primary-transferred in the primary transfer position, and which transports it to the secondary transfer position is provided.

The intermediate transfer apparatus 62 is formed with an intermediate transfer unit 64, such as an intermediate transfer belt or the like, a primary transfer roller 66, a wrapping-in roller 68, a wrapping-out roller 70, a secondary transfer backup roller 72, a scraper backup roller 74 and a brush backup roller 76.

The intermediate transfer unit 64 has, for example, elasticity, and is stretched above the rotary development device 38 substantially flat such that it has a longer side and a shorter side.

In addition, the upper longer side of the intermediate transfer unit 64 is stretched such that it is substantially parallel with the delivery section 36 provided in the upper portion of the image formation device 10.

In addition, the intermediate transfer unit 64 has a primary transfer section (or an image carrier wrapping area) which is butted against the image carrier 50 like a wrap between the wrapping-in roller 68 disposed upstream of the primary transfer roller 66 on the lower longer side of the intermediate transfer unit 64, and the wrapping-out roller 70 disposed downstream of the primary transfer roller 66, and is wrapped around the image carrier 50 only over a prescribed range to be moved as the image carrier 50 is rotated.

Thus, to the intermediate transfer unit 64, the developer images on the image carrier 50 are primary-transferred in the order of yellow, magenta, cyan, and black, for example, being put one upon another, by the primary transfer roller 66. The intermediate transfer unit 64 transports these primary-transferred developer images to the secondary transfer roller 80.

The wrapping-in roller 68 and the wrapping-out roller 70 are spaced from the image carrier 50. In addition, on the back side (or the right side in FIG. 2) of the intermediate transfer unit 64, a flat portion (or a shorter side) is formed by the wrapping-out roller 70 and the secondary transfer backup roller 72, and this flat portion is faced to the feeding path 28, being provided as the secondary transfer section. In addition, the wrapping-out roller 70 is disposed such that, in the secondary transfer section, an angle of, for example, 12 degrees is formed between the intermediate transfer unit 64 and the feeding path 28.

The scraper backup roller 74 aids a scraper 84 in scraping the developer being left on the intermediate transfer unit 64 after the secondary transfer, while a brush backup roller 76 aids a brush roller 86 in scraping the developer being left on the intermediate transfer unit 64 after the secondary transfer.

Above the upper longer side of the intermediate transfer unit 64, a sensor 78, such as a reflection-type photosensor or the like, is provided, being fixed to the back face (or the inside) of the open/close cover 14. The sensor 78 reads out a patch of the developer that is formed on the intermediate transfer unit 64 to detect the position of the intermediate transfer unit 64 in the direction of rotation thereof, and also detect the density of the developer.

To the secondary transfer backup roller 72 of the intermediate transfer apparatus 62, the secondary transfer roller 80 is faced, with the feeding path 28 being sandwiched therebetween. In other words, the location between the secondary transfer roller 80 and the secondary transfer backup roller 72 provides the secondary transfer position in the secondary transfer section. The secondary transfer roller 80 secondary-transfers to the paper sheet the developer images that are primary-transferred to the intermediate transfer unit 64, in the secondary transfer position with the aid of the secondary transfer backup roller 72. The secondary transfer roller 80 is kept separated from the intermediate transfer unit 64 while the intermediate transfer unit 64 is rotated three turns, in other words, the developer images of three colors, i.e., yellow, magenta, and cyan are transported. When the black developer image is transferred, the secondary transfer roller 80 is butted against the intermediate transfer unit 64.

At the opposite end of the image carrier side of the intermediate transfer unit 64, a cleaner 82 for the intermediate transfer unit is provided. This cleaner 82 for the intermediate transfer unit has, for example, a scraper 84 that scrapes, for cleaning, the developer being left on the intermediate transfer unit 64 after the secondary transfer, a brush roller 86 that further scrapes the developer being, left after the cleaning by the scraper 84, and a developer recovery bottle 88 that collects the developer scraped by the scraper 84 and the brush roller 86, and is adapted such that it is rocked around a rocking shaft 89. In other words, while the intermediate transfer unit 64 is transporting the developer image, the scraper 84 and the brush roller 86 are separated from the intermediate transfer unit 64. At a prescribed timing, these are butted against the intermediate transfer unit 64 as if they were an integral part.

In addition, to the brush roller 86, a voltage application section 100 is connected. The voltage application section 100 has a power supply, a selector switch and an adjusting resistor.

The power supply applies a bias voltage (or a V2 voltage) of, for example, approximately 3000 V to the brush roller 86 with the selector switch being turned on.

The selector switch is, for example, turned on before the scraper 84 and the brush roller 86 are butted against the intermediate transfer unit 64, and turned off after the scraper 84 and the brush roller 86 are spaced from the intermediate transfer unit 64.

When the selector switch is turned off, the brush roller 86 is connected to the ground (GND) through the adjusting resistor.

The adjusting resistor connects between the brush roller 86 and the ground with the selector switch being turned off, and adjusts the change in voltage of the brush roller 86.

Above the secondary transfer position, the fusing device 90 is disposed.

The fusing device 90, which has a heating roller 92 and a pressing roller 94, fixes the developer images that are secondary-transferred to the paper sheet by the secondary transfer roller 80 and the secondary transfer backup roller 72, to the paper sheet, and transports it towards the delivery roller 34.

The image formation unit 96 integrates the intermediate transfer apparatus 62, the image carrier 50, the charging unit 52, the cleaner 54 for the image carrier, and the cleaner 82 for the intermediate transfer unit.

This image formation unit 96 is disposed close to and under the delivery section 36 of the open/close cover 16 so as to be freely removable with respect to the main body of the image formation device 10, and thus can be removed by opening the open/close cover 16.

The image formation device 10 thus configured is capable of not only carrying out an ordinary printing operation that receives printing data sent to the image formation device 10 with a printing instruction, and forms that printing data on the paper in accordance with the printing conditions for outputting, but also carrying out trouble diagnosis operations for trouble diagnosis of the image formation device 10. One of the trouble diagnosis operations is the abnormal sound occurrence diagnosis operation pertaining to the present invention.

This abnormal sound occurrence diagnosis operation pertaining to the present invention is specifically an operation of identifying the cause for the abnormal sound occurring in the image formation device 10 by sequentially implementing each operation step in the operation sequence of the image formation device 10. Such operation is implemented with the diagnostic program 7 installed in the storage 6 being executed.

Figure 3:
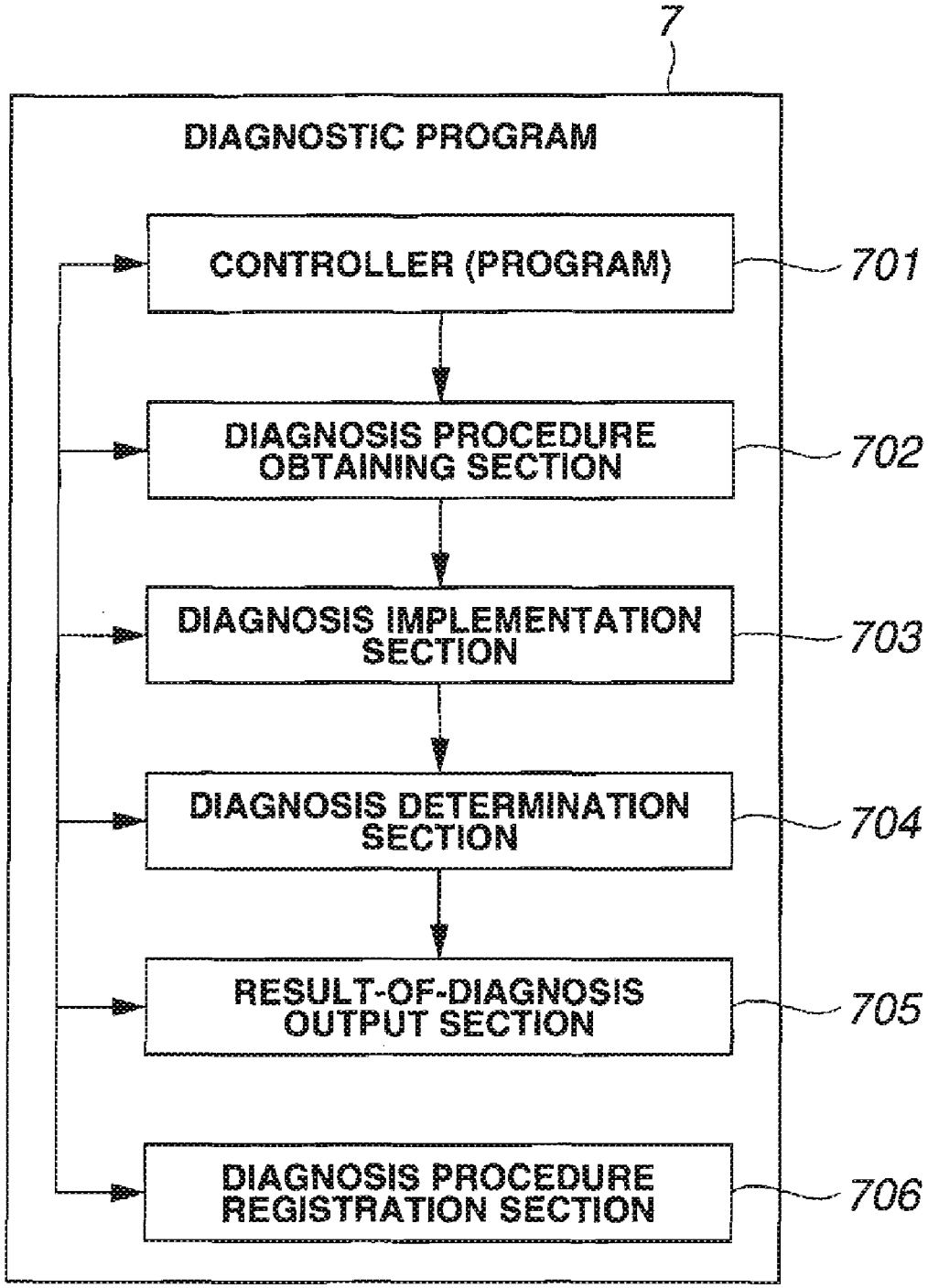
FIG. 3 is a block diagram illustrating one example of a functional configuration of a diagnostic program 7.

FIG. 3 is a block diagram illustrating one example of a functional configuration of the diagnostic program 7.

As shown in FIG. 3, the diagnostic program 7 is formed with a controller (program) 701, a diagnosis procedure acquisition section 702, a diagnosis implementation section 703, a diagnosis determination section 704, a result-of-diagnosis output section 705 and a diagnosis procedure registration section 706.

The controller (program) 701 provides the main program of the diagnostic program 7, and it supervisingly controls the processing operation of the respective sections constituting the diagnostic program 7.

The diagnosis procedure acquisition section 702 acquires from the storage 6 the diagnosis procedure information that indicates the diagnosis procedure for identifying the cause for occurrence of the abnormal sound in the image formation device 10.

This diagnosis procedure information provides information for classifying each operational sequence of generation of a latent image for image data, image development, paper transportation, transfer on paper sheet, fixing, delivery and the like, in the printing processing in the image formation device 10 into each operation step, and for associating the operational order with the respective operation steps as a result of the classification.

FIG. 4 is a chart schematically illustrating one example of diagnosis procedure information.

As shown in FIG. 4, a diagnosis procedure information 710 provides information for associating each operation step (or each diagnosis item) for identifying the cause for occurrence of the abnormal sound with the contents of operation therefor and the operation order therefor. By sequentially implementing the operations of the respective operation steps in accordance with the operation order as specified in this diagnosis procedure information 710, and determining whether the abnormal sound occurs during the operation, the cause for occurrence of the abnormal sound in the image formation device 10 can be identified.

For example, among the abnormal sound occurrence diagnosis operations, the first implemented operation is the diagnosis operation of the diagnosis item for the rotary development device that is provided with an operation order of 01 in the diagnosis procedure information 710. Specifically, this diagnosis operation involves driving the motor for the rotary development device to rotate the developing apparatus main body 40 having the developing apparatuses 44*a* to 44*d* for forming developer images of four colors (or yellow, magenta, cyan, and black), respectively, counterclockwise around the rotary development device center 44. In this condition, the user is requested to input the result of determination of whether the abnormal sound occurs. Then, on the basis of the result of determination of whether the abnormal sound occurs that is inputted by the user, the result of the diagnosis about the cause for occurrence of the abnormal sound is outputted before the driven motor for the rotary development device is stopped.

The operation orders for the respective operation steps as given in the diagnosis procedure information 710 are established such that the abnormal sound can be readily identified; for example, the operation steps that involve rotating the drive motor are initially specified, and then the operation steps that involve engaging the clutch to rotate the roller and the like are specified.

Additionally, if damage is expected to a related member by running the photosensitive drum or the like without preparation, an operation step before the operation to be checked may be incorporated in the operation sequence, and a bias is applied to adhere the toner prior to rotating the drum such that the cleaning blade is prevented from having a turn-over.

In the example diagnosis procedure information 710, the diagnoses are implemented in the order of the diagnosis of the rotary development device, the diagnosis of the fusing device, the diagnosis of the paper feed section, the diagnosis of the image generation section and the comprehensive diagnosis of the image formation section on the basis of the result of determination of whether the abnormal sound occurs through operating the motor, clutch or like the in the apparatus, mechanism or the like, which corresponds to each of the diagnosis items.

For the purpose of convenience, an image generation section refers to a portion which is made up of the apparatuses, mechanisms, rollers and the like, for carrying out the latent image formation, the image development and the transfer of image data, such as the image carrier 50, the rotary development device 38, the secondary transfer roller 80, the secondary transfer backup roller 72, the brush roller 86 and the like.

Additionally, in a case where the occurrence of the abnormal sound is found during the diagnosis of the paper feed section, the diagnosis is carried out in the order of the feed roller unit, the resist roller unit and the pre-resist roller unit in order to identify the cause for occurrence of the abnormal sound in the paper feed section in more detail. In a case where the occurrence of the abnormal sound is found during the diagnosis of the image generation section, the diagnosis is carried out in the order of the image generation drive section, the cleaner for the intermediate transfer unit and the secondary transfer section are carried out in order to identify the cause for occurrence of the abnormal sound in the image generation section in more detail.

Each operation step (or each diagnosis item) as given in the diagnosis procedure information 710, and the details of operation therefor as well as the operation order therefor are optionally alterable by the authorized user, and the diagnosis procedure information 710 is previously registered to be stored and held in the storage 6.

The details of operation for each operation step (or each diagnosis item) alone are also optionally alterable by the authorized user.

The diagnosis implementation section 703 sequentially implements the respective operation steps in accordance with the operation order as specified in the diagnosis procedure information to acquire various pieces of information required for the abnormal sound occurrence diagnosis.

The diagnosis determination section 704 carries out the diagnosis of the cause for occurrence of the abnormal sound on the basis of the information about whether the abnormal sound occurs at the time of implementation of the respective operation steps in accordance with the operation order as specified, and generates result-of-diagnosis information.

The result-of-diagnosis output section 705 processes the result-of-diagnosis information so as to suit to the output destination before outputting it.

The diagnosis procedure registration section 706 carries out registration and alteration of the operation steps and the operation order in the diagnosis procedure information.

Description will be made of a flow of the abnormal sound occurrence diagnosis operation pertaining to the present invention implemented by the image formation device 10 based on the command of the diagnostic program 7 as configured above, and operation procedures for implementing the abnormal sound occurrence diagnosis operation.

First, in order to cause the image formation device 10 to execute an abnormal sound occurrence diagnosis operation, a menu button as an operation button (not shown) in the user I/F section 4 of the image formation device 10 is depressed to display a menu on the display screen; from the menu items, the "diagnosis" is selected; from the diagnosis items displayed by selecting the "diagnosis", the "abnormal sound occurrence diagnosis" is selected; and the "OK" button is selected, whereby the abnormal sound occurrence diagnosis operation pertaining to the present invention is executed.

Depression of the menu button, and selection of a particular item of the menu and a particular diagnosis item are performed by the user, and the selection of the particular item of the menu and the particular diagnosis item can be achieved by the user directly touching the pertinent item among the menu items and the diagnosis items displayed on the display screen by a finger, or the like.

The control of such operation by the image formation device 10 is specifically made as follows: with the menu button provided in the user I/F section 4 being depressed, a signal indicating that the menu button is pressed is inputted from the user I/F section 4 to the controller 1, and the user I/F section 4 reads out, under the control of the controller 1, the screen data corresponding to the depressed operation button and the selected item from among the respective sets of screen data for the menu screen, the diagnosis item screen and the like, which are previously stored in the storage 6, thereby displaying it on the display screen.

When, from the selection items on the diagnosis item screen displayed, the "abnormal sound occurrence diagnosis" is selected, and the "OK" button displayed on the diagnosis item screen is selected by the user directly touching it by a finger, or the like, a signal indicating that the "abnormal sound occurrence diagnosis" is selected is inputted from the user I/F section 4 to the controller 1; the controller 1 reads out the diagnostic program 7 installed in the storage 6 for executing it; and under the control of the controller 1 on the basis of the command of the diagnostic program 7 executed, the abnormal sound occurrence diagnosis operation pertaining to the present invention is started.

Figure 5:
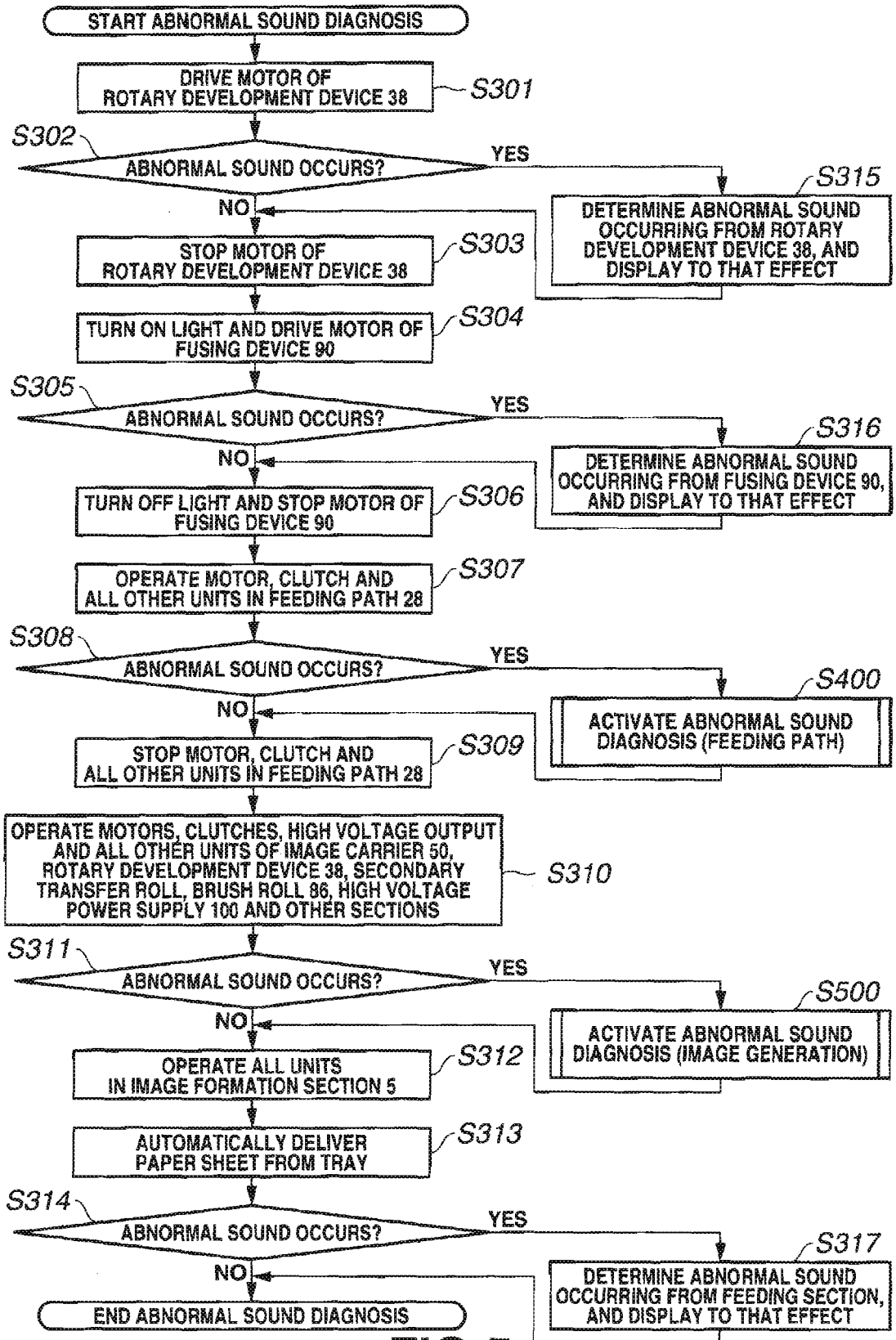
FIG. 5 is a flow chart illustrating the details of an abnormal sound occurrence diagnosis operation.
Figure 6:
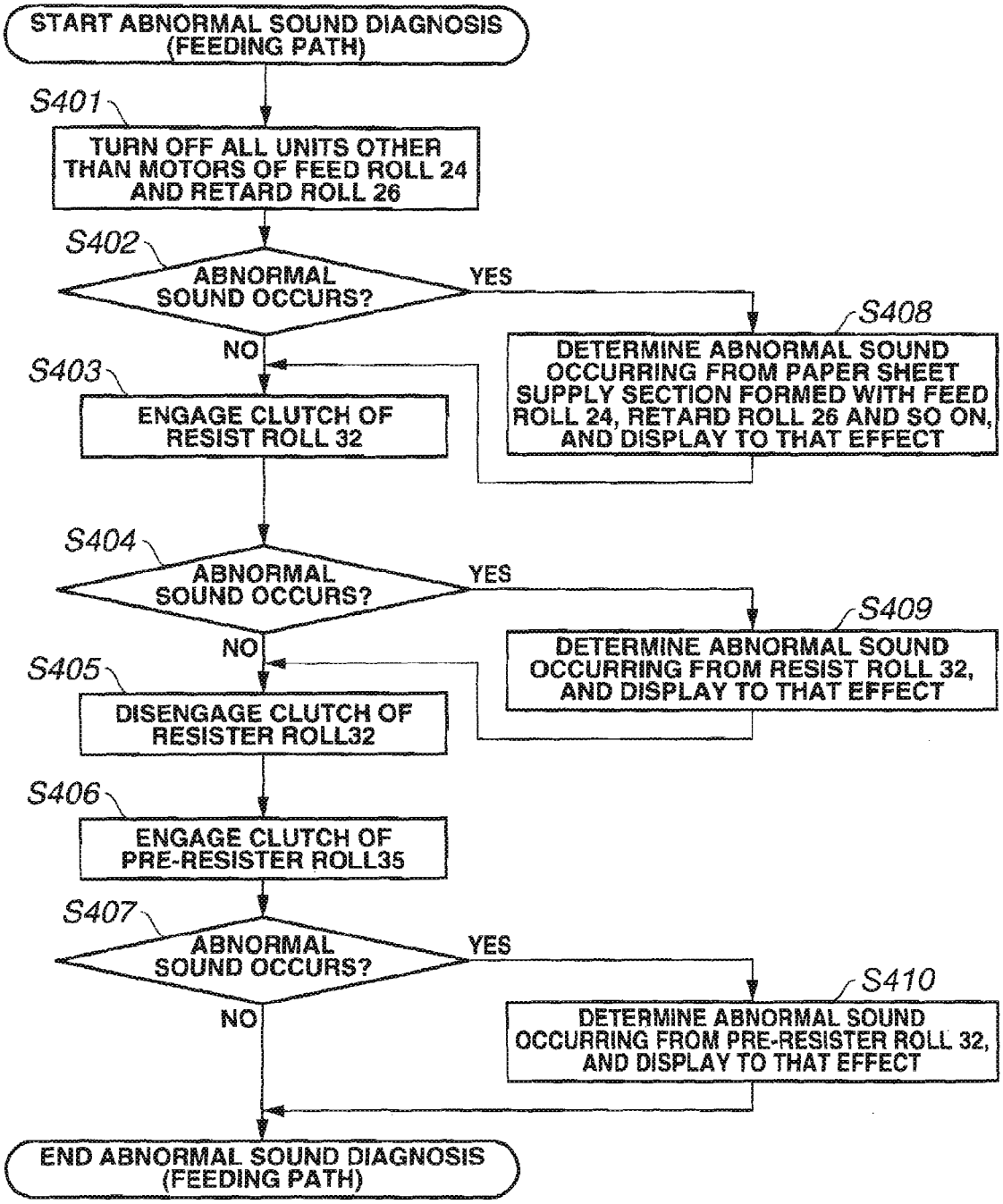
FIG. 6 is a flow chart illustrating the details of the abnormal sound occurrence diagnosis operation (for a feeding path)
Figure 7:
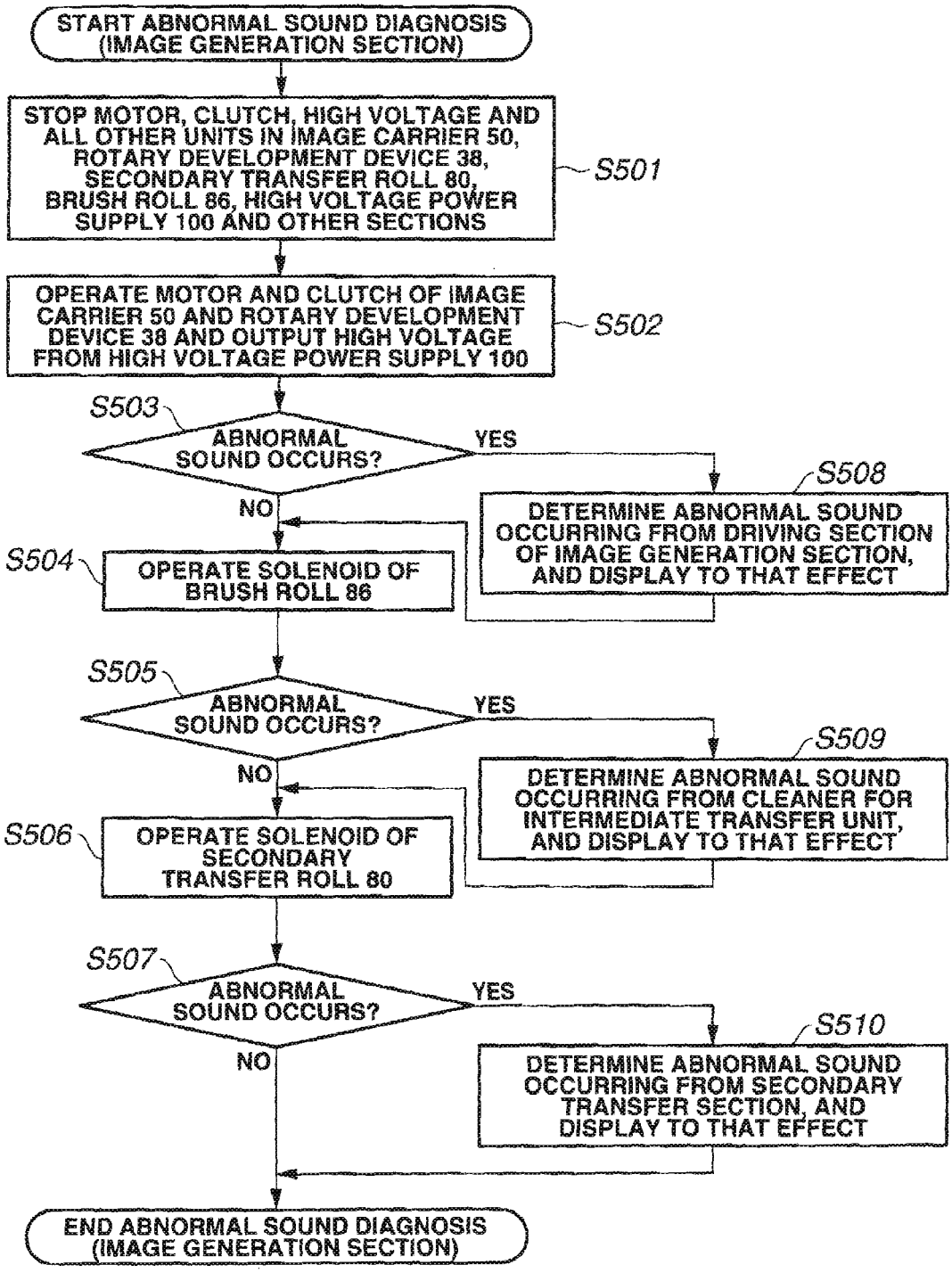
FIG. 7 is a flow chart illustrating the details of the abnormal sound occurrence diagnosis operation (for an image generation section).

Next, the details of the abnormal sound occurrence diagnosis operation will be described with reference to flow charts as shown in FIG. 5 to FIG. 7.

FIG. 5 to FIG. 7 are flow charts illustrating the details of the abnormal sound occurrence diagnosis operation.

As shown in FIG. 5, when the "abnormal sound occurrence diagnosis" is selected from among the selection items on the diagnosis item screen displayed on the display screen (not shown) in the user I/F section 4 of the image formation device 10 and the "OK" button is selected, the diagnostic program is executed and the abnormal sound occurrence diagnosis operation of the image formation device 10 is started.

In FIG. 5 to FIG. 7, the abnormal sound occurrence diagnosis operation is implemented under the control of the controller 1 on the basis of the command of the diagnostic program 7. However, for convenience of explanation of the control operation on the basis of the command of the diagnostic program 7, it will be described as the control operation of the controller 1.

When the abnormal sound occurrence diagnosis operation is started, the controller 1 causes a message of "abnormal sound occurrence diagnosis start" (not shown) to be displayed on the display screen of the image formation device 10; reads out the diagnosis procedure information 710 stored in the storage 6; and in accordance with the diagnosis procedure of the diagnosis procedure information 710, causes the motor in the rotary development device 38 in the image formation device 10 to be driven for carrying out the diagnosis of whether the abnormal sound occurs in the rotary development device 38 (step S301).

Specifically, under the control of the controller 1, the image formation section 5 causes the motor for the rotary development device 38 to be driven for counterclockwise rotating the developing apparatus main body 40 having the developing apparatuses 44*a* to 44*d* for forming developer images of four colors of yellow, magenta, cyan, and black, respectively, around the center 44 of the rotary development device.

Reading out of the diagnosis procedure information 710 from the storage 6 is implemented by the operation of the storage 6 under the control of the controller 1 on the command of the diagnosis procedure acquisition section 702 of the diagnostic program 7; displaying a message of "abnormal sound occurrence diagnosis start" is implemented by the operation of the user I/F section 4 under the control of the controller 1 on the command of the controller (program) 701; and driving control of the image formation section 5, such as that of the motor drive, or the like, for the rotary development device 38 is implemented by the operation of the image formation section 5 under the control of the controller 1 on the command of the diagnosis implementation section 703.

When the motor of the rotary development device 38 is driven, the controller 1 causes a message (not shown) of "Does abnormal sound occur? YES/NO" or the like to be displayed on the display screen of the image formation device 10 for prompting the user to input the result of determination of whether the abnormal sound occurs (step S302).

In a case where, at step S302, "YES" is selected (YES at step S302), it is determined that the cause for occurrence of the abnormal sound lies in the rotary development device 38, the determination being reported on the display screen with a message of "The cause for occurrence of the abnormal sound lies in rotary development device. Replacement is recommended." or the like, and the information about the date of diagnosis, the result of diagnosis and the like are accumulated and stored in the storage 6 as the history information (step S315), which is followed by the program proceeding to step S303.

In addition, in a case where, at step S302, "NO" is selected (NO at step S302), the motor for the rotary development device 38 is stopped (step S303), which is followed by the lamp on the fusing device 90 being lighted up, and the motor for the fusing device 90 being driven to rotate the heating roller 92 and the pressing roller 94 which are possessed by the fusing device 90 (step S304).

Displaying a message of "Does abnormal sound occur? YES/NO" or the like is implemented by the operation of the storage 6 under the control of the controller 1 on the command of the diagnosis implementation section 703; identifying the cause for occurrence of the abnormal sound on the basis of the information about whether the abnormal sound occurs in driving the image formation section 5 such as giving a determination of that the cause for occurrence of the abnormal sound lies in the rotary development device 38 or the like, and displaying a message of "The cause for occurrence of the abnormal sound lies in rotary development device. Replacement is recommended." or the like is implemented by the operation of the user I/F section 4 tinder the control of the controller 1 on the command of the diagnosis determination section 704; and outputting the result of diagnosis such as storing the history information into the storage 6 or the like is implemented by the operation of the image formation section 5 under the control of the controller 1 on the command of the result-of-diagnosis output section 705.

In addition, in a case where the user is to respond to a message of "Does abnormal sound occur? YES/NO?" or the like displayed on the display screen, the user can make a response by directly touching "YES" or "NO" of the displayed "YES/NO" by a finger or the like.

When the lamp on the fusing device 90 is lighted up and the motor is driven, the controller 1 causes a message (not shown) of "Does abnormal sound occur? YES/NO" or the like to be displayed on the display screen of the image formation device 10, prompting the user to input the result of determination of whether the abnormal sound occurs (step S305).

In a case where, at step S305, "YES" is selected (YES at step S305), it is determined that the cause for occurrence of the abnormal sound lies in the fusing device 90, the determination being reported on the display screen with a message of "The cause for occurrence of the abnormal sound lies in fusing device. Replacement is recommended." or the like, and the information about the date of diagnosis, the result of diagnosis and the like are accumulated and stored in the storage 6 as the history information (step S316), which is followed by the program proceeding to step S306

In addition, at step S305, in a case where "NO" is selected (NO at step S305), the lamp on the fusing device 90 is extinguished and the motor therefor is stopped (step S306), which is then followed by operating all of the motors, clutches and the like, which are for rotating the feed roller 24, the resist roller 32, and the delivery roller 34, in the apparatus or mechanism provided for paper transportation from the feed roller 24 to the delivery opening 30, which corresponds to the paper feed section for transporting paper along the feeding path 28 (step S307).

When all of the motors, clutches and the like in the paper feed section are operated, the controller 1 causes a message (not shown) of "Does abnormal sound occur? YES/NO" or the like to be displayed on the display screen of the image formation device 10, prompting the user to input the result of determination of whether the abnormal sound occurs (step S308).

In a case where, at step S308, "YES" is selected (YES at step S308), the abnormal sound occurrence diagnosis operation (for the feeding path) is carried out in order to identify the abnormal sound occurring portion in the feeding path 28 in more detail (step S400), which is followed by the program proceeding to step S309.

The details of the abnormal sound occurrence diagnosis operation (for the feeding path) at step S400 will be described later (see FIG. 6).

In addition, at step S308, in a case where "NO" is selected (NO at step S308), all of the motors, clutches and the like in the paper feed section of the feeding path 28 are stopped (step S309), which is followed by operating all the motors and clutches in the image generation section which is made up of the apparatuses, mechanisms, rollers and the like, such as the image carrier 50, the rotary development device 38, the secondary transfer roller 80, the secondary transfer backup roller 72, the brush roller 86 and the like for carrying out the latent image formation, the image development and the transfer of image data, and causing a high-voltage power supply 100 to output a high voltage (step S310).

When, at step S310, the motors, clutches and the like are operated, and the high-voltage power supply 100 is caused to output a high voltage, the controller 1 causes a message (not shown) of "Does abnormal sound occur? YES/NO" or the like to be displayed on the display screen of the image formation device 10, prompting the user to input the result of determination of whether the abnormal sound occurs (step S311).

In a case where, at step S311, "YES" is selected (YES at step S311), the abnormal sound occurrence diagnosis operation (for the image generation section) is carried out in order to identify the abnormal sound occurring portion in the image generation section in more detail (step S500), which is followed by the program proceeding to step S31.2.

The details of the abnormal sound occurrence diagnosis operation (for the image generation section) at step S500 will be described later (see FIG. 7).

In addition, in a case where, at step S311, "NO" is selected (NO at step S311), all the image formation section 5 is driven (step S312), which is followed by the feed roller 24 picking up a paper from the paper supply cassette 22 in the paper supply unit 18 into the feeding path 28, the paper being then transported along the feeding path 28 to be delivered from the delivery opening 30 (step S313).

When the paper transportation operation is implemented at step S313, the controller 1 causes a message (not shown) of "Does abnormal sound occur? YES/NO" or the like to be displayed on the display screen of the image formation device 10, prompting the user to input the result of determination of whether the abnormal sound occurs (step S314).

In a case where, at step S314, "NO" is selected (NO at step S314), the abnormal sound occurrence diagnosis operation is terminated, and in a case where "YES" is selected (YES at step S314), it is determined that the cause for occurrence of the abnormal sound lies in the paper feed section, the determination being reported on the display screen with a message of "The cause for occurrence of the abnormal sound lies in paper feed section. Replacement is recommended." or the like, and the information about the date of diagnosis, the result of diagnosis, and the like are accumulated and stored in the storage 6 as the history information (step S316), which is followed by the program terminating the abnormal sound occurrence diagnosis operation.

Next, the details of the abnormal sound occurrence diagnosis operation (for the feeding path) at step S400 will be described with reference to the flow chart as shown in FIG. 6.

As shown in FIG. 6, in order to carry out the abnormal sound occurrence diagnosis operation (for the feeding path), all of the motors, clutches and the like of the paper feed section driven under the control of the image formation section 5 on the basis of the control of the controller 1 other than the motors for the feed roller 24 and the retard roller 26 are stopped, in other words, the driving condition of only the feed roller 24 and the retard roller 26 being maintained (step S401), and a message (not shown) of "Does abnormal sound occur? YES/NO" or the like is displayed on the display screen of the image formation device 10, the user being prompted to input the result of determination of whether the abnormal sound occurs (step S402).

In a case where, at step S402, "YES" is selected (YES at step S402), it is determined that the cause for occurrence of the abnormal sound lies in the paper pick-up section made up of the feed roller 24, the retard roller 26 and the like in the paper feed section, the determination being reported on the display screen with a message of "The cause for occurrence of the abnormal sound lies in paper pick-up section in paper feed section. Replacement is recommended." or the like, and the information about the date of diagnosis, the result of diagnosis, and the like are accumulated and stored in the storage 6 as the history information (step S408), which is followed by the program proceeding to step S403.

In addition, in a case where, at step S402, "NO" is selected (NC) at step S402), the clutch for the resist roller 32 is connected to rotate the resist roller 32, and with the feed roller 24, the retard roller 26, the resist roller 32 being kept rotated (step S403), a message (not shown) of "Does abnormal sound occur? YES/NO" or the like is displayed on the display screen of the image formation device 10, the user being prompted to input the result of determination of whether the abnormal sound occurs (step S404).

In a case where, at step S404, "YES" is selected (YES at step S404), it is determined that the cause for occurrence of the abnormal sound lies in the resist roller 32, the determination being reported on the display screen with a message of "The cause for occurrence of the abnormal sound lies in resist roller unit. Replacement is recommended." or the like, and the information about the date of diagnosis, the result of diagnosis and the like are accumulated and stored in the storage 6 as the history information (step S409), which is followed by the program proceeding to step S405.

In addition, in a case where, at step S404, "NO" is selected (NO at step S404), the clutch for the resist roller 32 is disconnected (step S405), which is followed by the clutch for the preresist roller 35 being connected to rotate the preresist roller 35 (step S406), and a message (not shown) of "Does abnormal sound occur? YES/NO" or the like being displayed on the display screen of the image formation device 10, the user being prompted to input the result of determination of whether the abnormal sound occurs (step S407).

In a case where, at step S407, "NO" is selected (NO at step S407), the abnormal sound occurrence diagnosis operation (for the feeding path) is terminated, and in a case where "YES" is selected (YES at step S407), it is determined that the cause for occurrence of the abnormal sound lies in the preresist roller 35, the determination being reported on the display screen with a message of "The cause for occurrence of the abnormal sound lies in preresist roller unit. Replacement is recommended." or the like, and the information about the date of diagnosis, the result of diagnosis and the like are accumulated and stored in the storage 6 as the history information (step S410), which is followed by the program terminating the abnormal sound occurrence diagnosis operation (for the feeding path).

The details of the above-stated abnormal sound occurrence diagnosis operation (for the image generation section) at step S500 will be described with reference to the flow chart as shown in FIG. 7.

As shown in FIG. 7, in order to carry out the abnormal sound occurrence diagnosis operation (for the image generation section), operating of all the motors and clutches for the image carrier 50, the rotary development device 38, the secondary transfer roller 80, the secondary transfer backup roller 72, the brush roller 86 and the like in the image generation section that are driven under the control of the image formation section 5 on the basis of the control of the controller 1 is stopped, and the high-voltage output of the high-voltage power supply 100 is stopped (step S501), which is followed by driving the motors and clutches of the image carrier 50 and the rotary development device 38, and causing the high-voltage power supply 100 to output a high voltage (step S502).

When, at step S502, the motors and clutches for the image carrier 50 and the rotary development device 38 are operated, and the high-voltage power supply 100 is caused to output a high voltage, the controller 1 causes a message (not shown) of "Does abnormal sound occur? YES/NO" or the like to be displayed on the display screen of the image formation device 10, prompting the user to input the result of determination of whether the abnormal sound occurs (step S503).

In a case where, at step S503. "YES" is selected (YES at step S503), it is determined that the cause for occurrence of the abnormal sound lies in the drive section in the image generation section, the determination being reported on the display screen with such message as "The cause for occurrence of the abnormal sound lies in drive section in image generation section. Replacement is recommended", and the information about the date of diagnosis, the result of diagnosis and the like are accumulated and stored in the storage 6 as the history information (step S508), which is followed by the program proceeding to step S504.

In addition, in a case where, at step S503, "NO" is selected (NO at step S503), the solenoid for the brush roller 86 is operated to provide an operation of scraping the developer left on the intermediate transfer unit 64 (step S504), and in this condition, a message (not shown) of "Does abnormal sound occur? YES/NO" or the like is displayed on the display screen of the image formation device 10, the user being prompted to input the result of determination of whether the abnormal sound occurs (step S505).

In a case where, at step S505, "YES" is selected (YES at step S505), it is determined that the cause for occurrence of the abnormal sound lies in the cleaner for the intermediate transfer unit, the determination being reported on the display screen with a message of "The cause for occurrence of the abnormal sound lies in cleaner for intermediate transfer unit. Replacement is recommended." or the like, and the information about the date of diagnosis, the result of diagnosis and the like are accumulated and stored in the storage 6 as the history information (step S509), which is followed by the program proceeding to step S506.

In addition, in a case where, at step S505, "NO" is selected (NO at step S505), the solenoid for the secondary transfer roller 80 is operated to provide a secondary transfer operation (step S506), and in this condition, a message (not shown) of "Does abnormal sound occur? YES/NO" or the like is displayed on the display screen of the image formation device 10, the user being prompted to input the result of determination of whether the abnormal sound occurs (step S507).

In a case where, at step S507, "NO" is selected (NO at step S507), the abnormal sound occurrence diagnosis operation (for the image generation section) is terminated, and in a case where "YES" is selected (YES at step S507), it is determined that the cause for occurrence of the abnormal sound lies in the secondary transfer section, the determination being reported on the display screen with a message of "The cause for occurrence of the abnormal sound lies in secondary transfer section. Replacement is recommended." or the like, and the information about the date of diagnosis, the result of diagnosis and the like are accumulated and stored in the storage 6 as the history information (step S510), which is followed by the program terminating the abnormal sound occurrence diagnosis operation (for the image generation section).

In the above description, description is made of an example system which is configured such that, even if there is an operation step at which occurrence of the abnormal sound is identified, all the operation steps are sequentially implemented in accordance with the diagnosis procedure as given in the diagnosis procedure information 710 for identifying of whether the abnormal sound occurs. However, it may be possible to employ a configuration in which, in a case where, during implementation of a particular operation step, occurrence of the abnormal sound is identified, the result of determination of the cause for occurrence of the abnormal sound is displayed, and the history information is accumulated and stored, which is followed by causing the user to select whether the diagnosis of the cause for occurrence of the abnormal sound is to be continuously implemented at the subsequent operation step or not; in a case where it is to be continuously implemented, the subsequent operation step is implemented in accordance with the diagnosis procedure; and in a case where it is not to be continuously implemented, the abnormal sound occurrence diagnosis operation is terminated.

In this case, the configuration can be realized by forming the diagnosis implementation section 703 of the diagnostic program 7 such that a message of "The cause for occurrence of the abnormal sound lies in xxxxx apparatus. Replacement is recommended." or the like is displayed on the display screen on which the result of the diagnosis of the cause for occurrence of the abnormal sound is to be displayed, and a message of "Is diagnosis of next operation step to be continuously implemented? YES/NO" or the like is displayed to prompt the user to make a responsive input, and by configuring the controller (program) 701 such that, in a case where, for the message of "Is diagnosis of next operation step to be continuously implemented? YES/NO", "YES" is selected, the next operation step is implemented in accordance with the diagnosis procedure as given in the diagnosis procedure information 710, and in a case where "NO" is selected, the abnormal sound occurrence diagnosis operation is terminated.

Additionally, it may be possible to employ a configuration in which the diagnosis procedure of the diagnosis procedure information 710 is displayed on the display screen, and the user can start at a desired operation step, and thereafter sequentially implement the subsequent operation steps of the diagnosis of the cause for occurrence of the abnormal sound.

In this case, the configuration can be realized by forming the diagnosis implementation section 703 of the diagnostic program 7 such that, on the basis of the diagnosis procedure information 710, the diagnosis items (or the operation steps) of the respective priorities of operation are displayed on the display screen so as to allow the user to select the operation step at which the diagnosis is to be started, and starting from the selected diagnosis item (or the selected operation step), the subsequent operation steps are implemented in accordance with their priorities of operation as established in the diagnosis procedure information 710. Additionally, in a case where damage to a related member is expected due to abruptly running the photosensitive drum or the like and the operation step is selected so as to incorporate an operation immediately before the operation to be checked to prevent the cleaning blade from having a turn-over by applying a bias to adhere the toner prior to rotating the drum, a display to that effect is made. Then, for example, such message as "In order to implement selected operation step, implementation of xxxxx operation step is needed" is displayed to cause the user to make a reselection.

Additionally, it may be possible to employ a configuration in which the result of the diagnosis of the cause for occurrence of the abnormal sound is reported to the host computer 11 through the network 3, or to the service center of the manufacturer of the image formation device 10, or the like, by e-mail or through the Internet.

In this case, the configuration can be realized by including an e-mail communication capability, and the like, in the communication I/F section 2 in the image formation device 10, and configuring the result-of-diagnosis output section 705 of the diagnostic program 7 such that the result of the diagnosis of the cause for occurrence of the abnormal sound is reported to the host computer 11, the service center, or the like.

In addition, it may be possible to employ a configuration in which the abnormal sound occurrence diagnosis operation of the image formation device 10 is executed on an instruction from the host computer 11.

In this case, the configuration can be realized by installing a diagnostic program having the configuration as described heretofore in the host computer 11, or installing a printer driver having that configuration in the host computer 11, and configuring the controller 1 of the image formation device 10 such that it can interpret an instruction for executing an abnormal sound occurrence diagnosis operation that is given to the image formation device 10 from the host computer 11 for controlling the respective sections of the image formation device 10.

In addition, it may be possible to employ a configuration in which the abnormal sound occurrence diagnosis operation pertaining to the present invention as described heretofore is carried out by the controller 1 of the image formation device 10 with no use of the diagnostic program 7.

In this case, the configuration can be realized by configuring the controller 1 such that it has the same configuration for implementing the abnormal sound occurrence diagnosis operation pertaining to the present invention as is possessed by the diagnostic program 7.

The present invention is applicable to a diagnosis technique for identifying the cause for occurrence of the abnormal sound that occurs in any particular apparatus.

The foregoing description of the exemplary embodiment of the present invention is provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An abnormal sound diagnostic apparatus for an image formation device to perform a printing processing having a series of sequential operation steps of forming a latent image corresponding to an image, developing the latent image and transferring the developed image on a paper sheet, fixing the transferred image on the paper sheet, and delivering the paper sheet, the diagnostic apparatus comprising:

a storing section that stores diagnostic procedure information in which a series of sequential operation steps of the printing processing are divided into functional units of a paper delivering function and an image formation function and an operation order of the divided functions are specified;

a first drive control section that sequentially drives drive mechanisms according to the operation order of the respective functions in the diagnostic procedure information stored in the storing section, each of the drive mechanisms being respectively driven according to the series of the sequential operation steps of the functions;

a first receiving section that receives confirmation information whether or not an abnormal sound occurs when the first drive control section drives the drive section, the confirmation information being inputted at each time of driving of the drive mechanisms by the first drive control section;

a second drive control section that independently and sequentially drives each of the drive mechanisms for each operation step, and stops the drive mechanisms being driven by the first drive control section when the first receiving section receives the confirmation information that an abnormal sound occurs, each of the drive mechanisms being respectively driven according to the series of the sequential operation steps of the functions;

a second receiving section that receives the confirmation information whether or not an abnormal sound occurs, the confirmation information being inputted each time the second drive control section drives each of the drive mechanisms according to each operation step of the functions; and an identifying section that identifies a drive mechanism being driven by the second drive control section as an abnormal sound occurring location when the second receiving section receives the confirmation information that the abnormal sound occurs.

2. The abnormal sound diagnostic apparatus for the image formation device according to claim 1, wherein in a case where a drive section exists that requires a preliminary operation to normally drive the drive mechanisms of each of the functions according to the operation order specified by the diagnostic procedure information, preliminary operation is carried out prior to driving the drive section.

3. The abnormal sound diagnostic apparatus for the image formation device according to claim 1, further comprising a display section that display information indicative of the drive mechanisms corresponding to the functions in association with the confirmation information received by the first receiving section at each time of driving of the drive mechanisms of the functions.

4. The abnormal sound diagnostic apparatus for the image formation device according to claim 1, wherein the second drive control section further comprises a stop controller that controls stop operation of the driving of the drive mechanisms of the functions driven by the first drive control section when the first receiving section receives the confirmation information.

5. The abnormal sound diagnostic apparatus for the image formation device according to claim 1, further comprising:

a third drive control section that independently drives each of the drive mechanisms according to the operation order of the drive mechanisms specified by the diagnostic procedure information; and a third receiving section that receives the confirmation information whether or not an abnormal sound occurs by driving each of the drive mechanisms by the third drive control section; wherein the diagnostic procedure information includes information in which a driving order of a plurality of driving mechanisms are specified, the driving mechanisms being able to be independently driven according to each of the operation steps, and the identifying section identifies a drive section driven by the third drive control section as an abnormal sound occurring location when the third receiving section receives the confirmation information that an abnormal sound occurs.

6. An abnormal sound diagnostic method for an image formation device, comprising:

specifying by a specification section an operation order of sequential operation steps storing, by a storing section, diagnostic procedure information in which a series of sequential operation steps of a printing processing comprising the steps of forming a latent image corresponding to an image, developing the latent image and transferring the developed image on a paper sheet, fixing the transferred image on the paper sheet, and delivering the paper sheet are divided into functional units of a paper delivering function and an image formation function, and operation orders of the divided functions are specified;

sequentially driving, by a first drive control section, drive mechanisms according to an operation order of the respective functions in the diagnostic procedure information stored in the storing section, each of the drive mechanisms being respectively driven according to the series of the sequential operation steps of the functions;

receiving by a first receiving section confirmation information whether or not an abnormal sound occurs when the driving first drive control section drives the drive mechanisms;

independently and sequentially driving by a second drive control section for each operation step the drive mechanisms respectively driven in the series of operation steps of the functions, after having stopped the drive mechanisms corresponding to the functions being driven by the first drive control section when the first receiving section receives the confirmation information that an abnormal sound occurs;

receiving by a second receiving section the confirmation information whether or not an abnormal sound occurs when the second drive control section drives the drive mechanisms; and identifying by an identifying section the drive mechanism being driven by the second drive control section as an abnormal sound occurring location when the second receiving section receives the confirmation information that the abnormal sound occurs.

7. A non-transitory computer readable recording medium storing an abnormal sound diagnostic program that causes a computer to execute a process, the process comprising:

storing, by a storing section, diagnostic procedure information in which a series of sequential operation steps of a printing processing comprising the steps of forming a latent image corresponding to an image, developing the latent image and transferring the developed image on a paper sheet, fixing the transferred image on the paper sheet, and delivering the paper sheet are divided into functional units of a paper delivering function and an image formation function, and operation orders of the divided functions are specified;

sequentially driving, by a first drive control section, drive mechanisms according to operation orders of the respective functions in the diagnostic procedure information stored in the storing section, each of the drive mechanisms being respectively driven according to the series of the sequential operation steps of the functions;

receiving by a first receiving section confirmation information whether or not an abnormal sound occurs when the first drive control section drives the drive mechanisms;

independently and sequentially driving by a second drive control section for each operation step the drive mechanisms respectively driven in the series of operation steps of the functions, after having stopped the drive mechanisms corresponding to the functions being driven by the first drive control section, when the first receiving section receives the confirmation information that an abnormal sound occurs;

receiving, by a second receiving section, the confirmation information whether or not an abnormal sound occurs when the second drive control section drives the drive mechanisms; and identifying by an abnormal sound identifying section the drive mechanisms being driven by the second drive control section as an abnormal sound occurring location when the second receiving section receives the confirmation information that the abnormal sound occurs.

* * * * *